United States Patent [19]

Chen

[11] Patent Number: 4,862,530

[45] Date of Patent: Sep. 5, 1989

[54] CONVERTIBLE BED

[76] Inventor: Chung C. Chen, 5505 Miles Ct., Springfield, Va. 22151

[21] Appl. No.: 78,579

[22] Filed: Jul. 27, 1987

[51] Int. Cl.[4] ..... A61G 7/04

[52] U.S. Cl. ..... 5/66; 5/68

[58] Field of Search ..... 5/60, 66–69

[56] References Cited

U.S. PATENT DOCUMENTS

| | | | |
|---|---|---|---|
| 1,228,434 | 6/1917 | Hedberg . | |
| 2,562,824 | 2/1971 | White . | |
| 2,598,204 | 5/1952 | Allen . | |
| 2,853,717 | 9/1952 | Firsel . | |
| 2,912,632 | 11/1959 | Turtil . | |
| 2,990,503 | 6/1961 | Clark . | |
| 3,089,113 | 5/1963 | Mohr . | |
| 3,239,853 | 3/1966 | MacDonald | 5/68 |
| 3,311,188 | 3/1967 | Gutshall . | |
| 3,414,324 | 12/1968 | Taylor et al. . | |
| 3,646,896 | 3/1972 | Derujinsky et al. | 108/139 |
| 3,913,153 | 10/1975 | Adams et al. | 5/68 |
| 4,133,305 | 1/1979 | Steur . | |
| 4,215,680 | 8/1980 | Okuda . | |
| 4,333,681 | 6/1982 | Nelson . | |
| 4,432,353 | 2/1984 | Vrzalik . | |
| 4,563,784 | 1/1986 | Shrock et al. . | |
| 4,597,119 | 7/1986 | Padgett | 5/60 X |

FOREIGN PATENT DOCUMENTS

| | | | |
|---|---|---|---|
| 2403791 | 5/1979 | France | 5/68 |
| 245197 | 1/1926 | United Kingdom | 5/60 |
| 523334 | 7/1940 | United Kingdom | 5/68 |

*Primary Examiner*—Gary L. Smith
*Assistant Examiner*—Michael F. Trettel
*Attorney, Agent, or Firm*—Chung-Chin Chen; Daniel J. Stanger

[57] ABSTRACT

The convertible bed of this invention includes a bed which can be converted to a chair so that the user can sit on it. The user can push a button to actuate a driving means to rotate the chair so that the user can easily fall into sleep, where the button can be released naturally, and the chair can automatically convert to a bed. A brake means, a speed control means, a safety belt for restraining the user, and warning lights are also provided.

7 Claims, 2 Drawing Sheets

CONVERTIBLE BED

This invention relates to a convertible bed and particularly to such a bed for helping people fall asleep.

Certain persons for various reasons suffer from insomnia.

Various medicines, apparatus (e.g., sleeping pills, audio/visual means) and vibrating devices have been developed for assisting such persons. Steuer 4,133,305 depicts one example of a vibrating device.

The convertible bed of this invention utilizes a bed which can be converted to a chair so that the user can sit on it. The user can push a button to actuate a driving means to rotate the chair so that the user can easily fall into sleep, whereupon the button can be released naturally so that the chair converts automatically to a bed. A brake means, a speed control means, a safety belt for restraining the user, and warning lights are also provided.

Figure 1:
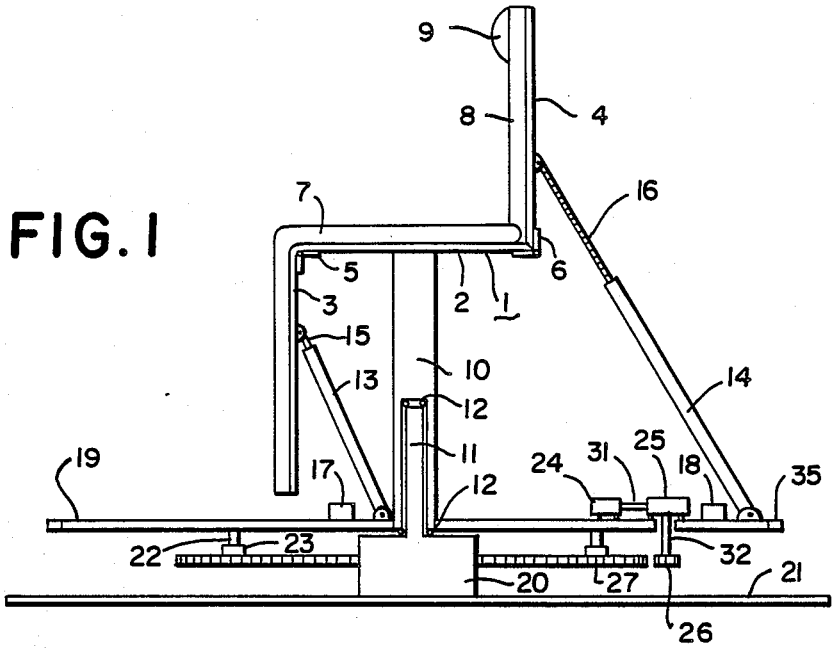
FIG. 1 is a diagrammatic view of a first embodiment of the present invention, showing the convertible bed serving as a chair.
Figure 2:
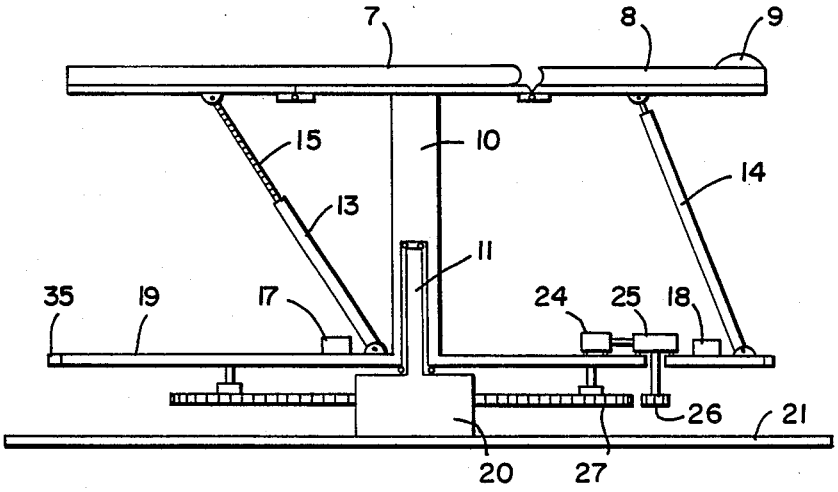
FIG. 2 is similar to FIG. 1, showing the convertible bed serving as a bed.
Figure 3:
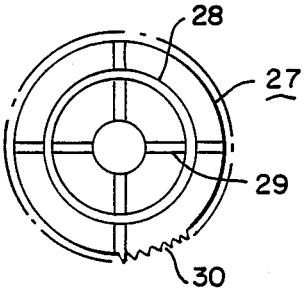
FIG. 3 is a top view of a frame having gears, shown in a reduced scale compared with that of FIG. 2.

FIG. 1 and FIG. 2 show the first embodiment of the present invention. The convertible bed includes mainly a cushion supporting frame 1 fastened to an outer supporting rod 10, an inner supporting rod 11, collars 13, 14, and screw members 15, 16 for pushing or pulling the frame 1, and a motor 24 for driving the convertible bed when it serves as a bed.

The cushion supporting frame 1 has three sections: a seat section 2, a leg section 3, and a back section 4. The seat section 2 is connected with hinges 5 and 6 to the leg section 3 and to the back section 4, respectively. A cushion section 8 is fastened to the back section 4. Another cushion section 7 is fastened to the seat section 2, and to the leg section 3. A pillow 9 is fastened to the cushion section 8.

A plurality of bearings 12 are provided between the inner supporting rod 11, and the outer supporting rod 10. The inner supporting rod 11 has an enlarged lower portion 20 which is fixed to a base frame 21 for stabilizing the bed. The collar 13, the screw member 15, and a motor are portions of a conventional power screw shown in, e.g., Hedberg 1,228,434, Schenk 2,857,226, or King 3,288,090. The collar 13 is pivotally connected at its lower end to a horizontal frame 19 which is fixed to the outer supporting rod 10. The screw member 15 is pivotally connected at its upper end to the leg section 3. The power screw thus formed is a driving means for pushing or pulling the leg section 3 and the lower portion of the cushion section 7. Of course, a conventional double acting hydraulic cylinder can also be utilized for this purpose. Similarly, the collar 14, the screw member 16, and a motor 18, can be conventionally utilized for pushing or pulling the back section 4 and the cushion section 8. A single driving means, instead of two as shown above, can be employed to push or pull both the leg section 3 and the back section 4 simultaneously through a well-known mechanical arrangement not shown in the drawings.

The motor 24 has a shaft 31 which is connected to a speed reduction means 25 which has a shaft 32 having a gear means 26 fixed at its lower end.

A frame 27 having gears 30 engageable with the gear means 26 is fastened to the enlarged portion 20 of the inner supporting rod 11. The frame 27 has at least one concentric ring 28, and at least one strut 29.

At least two supporting tubes 22 are fixed to the lower surface of the horizontal frame 19 and have rollers 23 rotatably attached to their lower ends. The rollers 23 can contact the ring 28 of the frame 27 and slide thereon when the motor 24 is turned on so as to stabilize the horizontal frame 19.

A control means 33, a safety belt 43, and a switch 37 are located on the cushion section 7. A safety belt 34, and a switch 36 are located on the cushion section 8. The control means 33 has a button 38 for controlling the back section 4, a button 39 for controlling the leg section 3, a button 40 for controlling the on-off of the motor 24, a speed control knob 42 for adjusting the speed of the motor 24, and a brake button 41 for braking the motor 24. When the button 38 is pushed toward the direction of an arrow 47, the screw member 16 will be extended so as to raise the back section 4. When button 38 is pushed toward the direction of an arrow 46, the back section 4 will be lowered. Similarly, when the button 39 is pushed toward the direction of an arrow 45 or 44, the leg section 3 can be lowered or raised, respectively.

At least one warning light 35 can be provided on the edge of the horizontal frame 19. The light 35 can be turned on when the motor 24 is turned on. In order to prevent the switches (buttons) 38, 39 and 40 from being inadvertently turned on when the user has fallen asleep, another extra button (not shown in drawings) can be provided, e.g., on one end of the control means 33 so that each of the switches 38, 39, and 40 cannot be actuated unless the extra button is pushed.

Figure 4:
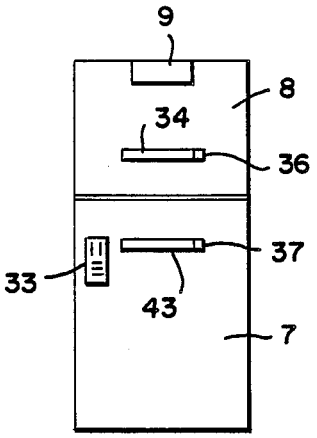
FIG. 4 is a top view of a part of the bed shown in FIG. 2, showing only cushion sections, safety belts, a pillow and a control means, shown in a reduced scale compared with that of FIG. 2.

In the above-mentioned first embodiment of the invention, the cushion is of the overall shape of a rectangle (FIG. 4).

In the second embodiment of the invention, the cushion is of the overall shape of a circle (FIG. 5), in which two "wing" sections 48 and 49 are provided on two sides of the cushion sections 8 and 7 so that the whole bed can be a circular bed. Of course, the cushion supporting frame 1 has corresponding "wing" sections (not shown in the drawings) for supporting the wing sections 48 and 49.

Figure 5:
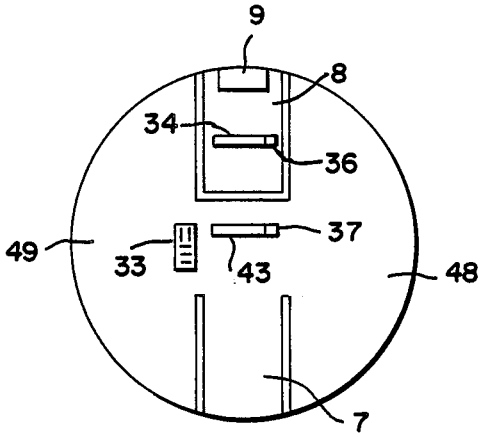
FIG. 5 is a top view similar to that shown in FIG. 4, showing a second embodiment of the present invention.
Figure 6:
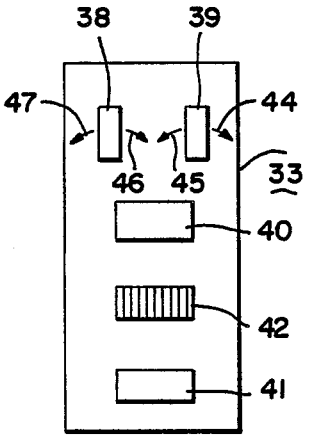
FIG. 6 is an enlarged top view of a control means utilized in the present invention.
Figure 7:
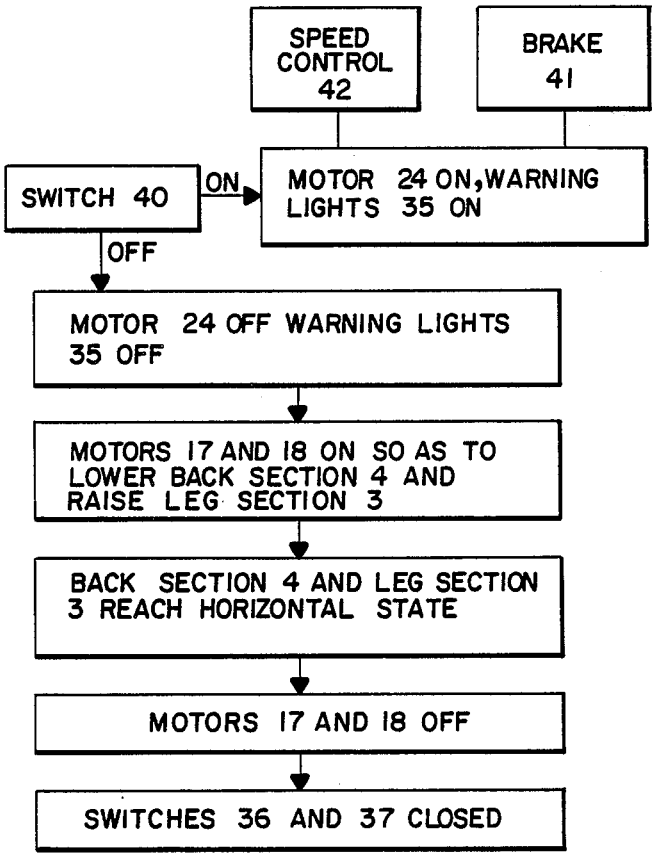
FIG. 7 is a flow chart showing an automatic control part of the present invention.

The user can actuate switches 38 and 39 to move the back section 4 and leg section 3 from the state shown in FIG. 2 to that shown in FIG. 1, with the two sections 3 and 4 at a comfortable angle with respect to the seat section 2. Then, if desired, a blanket or the like can cover on the user. The user can fasten the seat belts 34 and 43, select a desirable speed (e.g., 4 r.p.m.) by adjusting the speed control knob 42, and push the normally-open switch 40 to turn on the motor 24 and the warning lights 35. Thus the bed will rotate to facilitate the falling into sleep of the user. After the user has fallen asleep, the finger of the user which is pushing the switch 40 will relax and the switch 40, the motor 24, and the warning light 35 will be turned off. Meanwhile, motors 17 and 18 will be actuated automatically by a control circuit (not shown in the drawing) so that the leg section 3 and the back section 4 can be raised and lowered, respectively to a horizontal state shown in FIG. 2. At this time, the "upper" extreme position of the screw member 15 and the "lower" extreme position of the screw member 14 can be reached (as shown in FIGS. 2, 4, and 5). Then the said control circuit can turn off the motors 17 and 18 automatically, and actuate the switches 36 and 37 so that the safety belts 34 and 43 can be released and automatically retracted by a conventional means (e.g., release mechanism shown in Gutshall 3,311,188) not shown in the drawings. The safety belts 34 and 43 can also be manually released when necessary. Preferably, the upper surface of the switches 36, 37; the control means 33; and the ends of the safety belts 34 and 43 after being retracted can be at the same level as the upper surface of the cushion sections 7 and 8.

The motors 17, 18, and 24 can be of the low-noise type or covered with sound-insulation material. The transmission means for motor 24 can be belt-driven or the like instead of gears as shown in FIGS. 1 and 2. The motors 17, 18, and 24 can utilize a battery power source or a conventional rotary coupling means (e.g., Mohn 3,089,113) can be used so that a power line can be plugged to a socket on the wall. The control means for controlling the speed or direction or for braking the motor is conventional (e.g., Clark 2,990,503, and Turtil 2,912,632) and thus will not be described in detail.

It is to be understood that the scope of the invention is not limited to the above description, but may be modified within the scope of the appended claims.

I claim:

1. A convertible bed, comprising:

a first frame having a rotational axis and being rotatable about its rotational axis, including a back section, a seat section adjacent to said back section, and a leg section adjacent to said seat section, wherein said first frame can assume a first orientation;

first driving means for moving the back section relative to the seat section;

second driving means for moving the leg section relative to the seat section;

third driving means for rotating the first frame about its rotational axis;

first control means for controlling the third driving means so that the third driving means continually rotates the first frame about its rotational axis as long as the first control means is activated; and;

second control means, responsive to deactivation of the first control means, for controlling the operation of the three driving means so that when the first control means is deactivated, the first frame gradually converts from said first orientation to a second orientation.

2. The convertible bed of claim 1, wherein rotation of the first frame ceases upon deactivation of the first control means.

3. The convertible bed of claim 1, wherein said first control means is arranged to be activated by an occupant of the convertible bed.

4. The convertible bed of claim 1, further comprising a support comprising an outer supporting rod fixed to the first frame, an inner supporting rod supporting the outer supporting rod, a second frame fixed to the outer supporting rod, a third frame fixed to the inner supporting rod and having gears and at least one ring, at least two rollers slidably fixed to the second frame and contacting the ring of the third frame, and a base frame fastened to the lower end of the inner supporting rod.

5. The convertible bed of claim 4, further comprising:

at least one warning light attached to the second frame.

6. The convertible bed of claim 1, wherein the third driving means includes a motor, a speed reduction means, a speed control means, and a brake means, and said convertible bed further comprises:

an occupant restraining means, said restraining means including a safety belt, a manual release mechanism, an automatic release mechanism, and an automatic rewinding mechanism.

7. The convertible bed of claim 1, wherein said first frame further comprises two wing sections, said convertible bed further comprising:

a first cushion attached to said back section; and a second cushion attached to both said seat section and said leg section, wherein each of the first and second cushions has at least two wing sections to cover the wing sections of the first frame.

* * * * *